US005285969A

United States Patent [19]

Greiner et al.

[11] Patent Number: 5,285,969

[45] Date of Patent: Feb. 15, 1994

[54] ELECTROMAGNETICALLY OPERATED FUEL INJECTION VALVE

[75] Inventors: Max Greiner, Gerlingen; Peter Romann, Stuttgart; Ferdinand Reiter, Markgröningen; Rudolf Babitzka, Kirchberg-Neuhof, all of Fed. Rep. of Germany

[73] Assignee: Robert Bosch GmbH, Stuttgart, Fed. Rep. of Germany

[21] Appl. No.: 989,720

[22] Filed: Dec. 14, 1992

Related U.S. Application Data

[63] Continuation of Ser. No. 720,851, Jul. 11, 1991, abandoned.

[30] Foreign Application Priority Data

Nov. 25, 1989 [DE] Fed. Rep. of Germany ..... 3939093

[51] Int. Cl.[5] ..... B05B 1/34

[52] U.S. Cl. ..... 239/463; 239/585.4; 239/585.1; 239/900

[58] Field of Search ..... 239/585.1, 585.4, 463, 239/900; 251/129.15

[56] References Cited

U.S. PATENT DOCUMENTS

| | | | |
|---|---|---|---|
| 4,403,741 | 9/1983 | Moriya et al. | 239/585.4 |
| 4,423,843 | 1/1984 | Palma | 239/585.4 |
| 4,477,027 | 10/1984 | Knapp et al. | 239/463 |
| 4,585,174 | 4/1986 | Knapp | 239/585.1 |
| 4,971,254 | 11/1990 | Daly et al. | 239/585.1 |
| 4,981,266 | 1/1991 | Aichele et al. | 239/463 |

FOREIGN PATENT DOCUMENTS 3102642 1/1982 Fed. Rep. of Germany .

*Primary Examiner*—Andres Kashnikow
*Assistant Examiner*—Lesley D. Morris
*Attorney, Agent, or Firm*—Michael J. Striker

[57] ABSTRACT

An electromagnetically operated fuel injection valve has a valve housing, a valve seat body having a valve seat and a guide cylinder, a valve closing element projecting in the guide cylinder and supporting a ball type valve closing body around which fuel can flow through spiral flutes in which the valve closing element releases or interrupts a fuel flow by sitting on or lifting off the valve seat. The valve seat body in addition to the guide cylinder and the valve seat, also contains at least one outlet orifice. The valve seat body is provided with an all-round spiral flute between the guide cylinder and the valve seat.

8 Claims, 2 Drawing Sheets

ELECTROMAGNETICALLY OPERATED FUEL INJECTION VALVE

This is a continuation of application Ser. No. 720,851 filed Jul. 11, 1991, now abandoned.

BACKGROUND OF THE INVENTION

The present invention is related to a fuel injection valve having a valve housing, a valve seat body with a guide cylinder, and a valve closing element projecting into the guide cylinder.

A fuel injection valve of the generic type is already known from DE-PS 31 02 642. In this design, a guide ring with the guide cylinder and the valve seat on the one hand, and on the other hand a part described as a jet with an orifice for the fuel to be injected, form separate parts. The guide ring is held in the jet with a press fit. This requires high dimensional accuracy of the individual parts and considerable effort in fitting the fuel injection valve. In fitting the fuel injection valve, minor excesses of the dimensional tolerances of these individual parts can cause a deformation of the valve seat and poor concentricity of the guide cylinder to the valve seat and to the orifice, leading to an increased irregular fuel radiation pattern.

SUMMARY OF THE INVENTION

The fuel injection valve of this invention has the advantage that the fitting effort is reduced and that guide cylinders, valve seat, and injection orifice are accurately aligned with the axis of the valve seat body. This high accuracy is possible within close tolerances. A consistently precise response of the fuel injection valve with constantly accurate injection timing, and precise metering of the fuel is achieved with improved fuel radiation pattern.

For a low-cost and dimensionally accurate manufacture it is particularly advantageous to produce the guide cylinder and/or valve seat and/or spiral flute by stamping.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
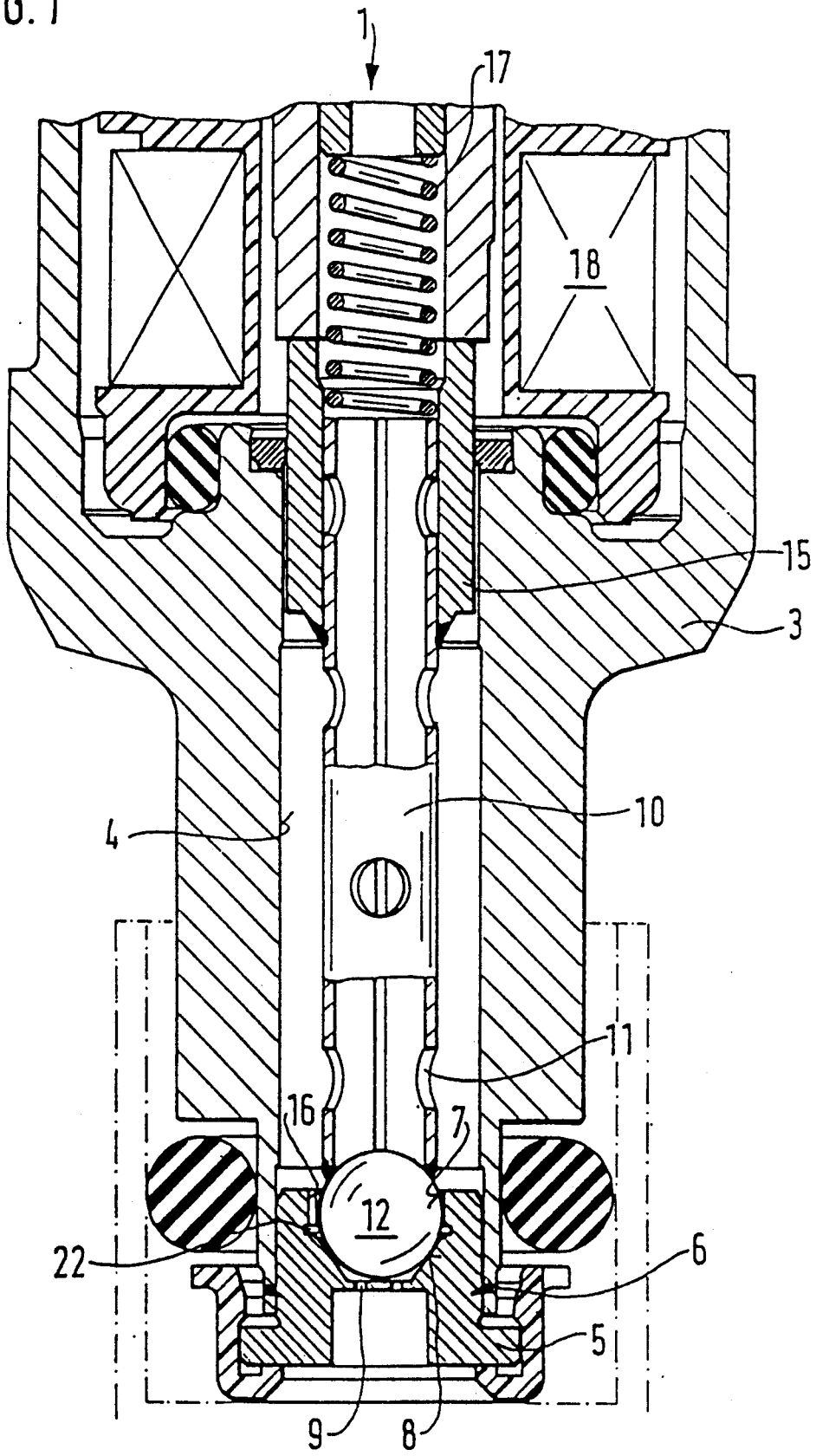
FIG. 1 shows a sectional view of a valve seat area of a fuel injection valve.

The fuel injection valve 1 for a fuel injection unit in mixture compressing, positively ignited internal combustion engines has a valve housing 3 with a port 4, in which a valve body 5 is fixed by means of a welded connection 6. The valve body 5 is provided with a central, bore type guide cylinder 7. Downstream of the guide cylinder 7 the valve seat body 5 additionally has a valve seat 8 and, following this, at least one outlet orifice 9 for the fuel injection into the induction manifold of an internal combustion engine.

Projecting through the port 4 is a tube shaped valve closing element 10 with radial orifices 11. On the side facing the valve seat 8, the valve closing element 10 carries a valve closing body 12, for example, in the form of a hardened ball. On the side turned away from the valve seat 8, the valve closing element 10 carries an armature 15 of soft magnetic material. The valve closing body 12 projects, with little play, into the guide cylinder 7, and in the closed condition of the fuel injection valve 1, it rests against the valve seat 8. The wall of the guide cylinder 7 has spiral flutes 16 which run obliquely to the axis of the valve closing element 10. A groove like surrounding flute 22 runs in ring form between the guide cylinder 7 and valve seat 8 and thereby interrupts the transition of the spiral flutes 16 to the valve seat 8.

The valve closing element 10 is subjected to pressure in the closing direction from a pressure spring 17. A magnetic coil 18 is arranged adjacent to the armature 15 in such a way that as soon as it is excited, it lifts the armature in a direction opposed to the direction of closing.

Figure 2:
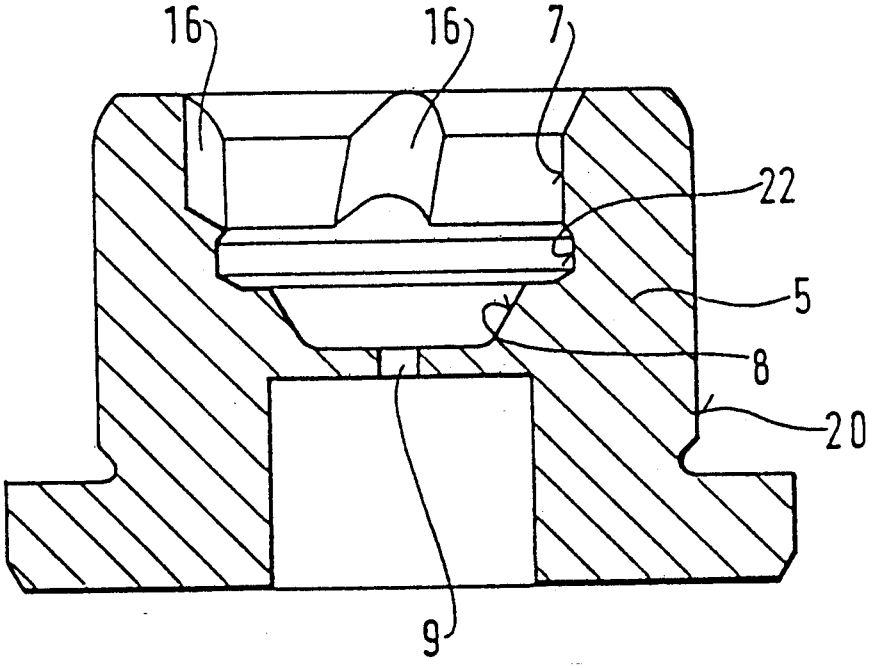
FIG. 2 shows a the valve seat body of the fuel injection valve.

The valve seat body 5 shown in figure 2 clearly shows the spiral flutes 16 which are inclined in relation to the axis of the valve seat body 5. The valve seat 8 and at least the one outlet orifice 9 are also recognizable. In this embodiment of the valve seat body 5, particular machining accuracy is required for the guide cylinder 7 with which the valve seat 8 must be concentric in order for the valve closing element 10 to lift rapidly from the valve seat 8 during opening, and to rapidly close during the closing action. The friction path between the valve closing element 10 and the valve seat 8 is thus kept as short as possible. A surface area 20 of the valve seat body 5 may be allowed to be slightly eccentric in relation to the guide cylinder 7, since, due to the length of the valve closing element 10 and the ball shape of the valve closing body 12, this does not have an adverse effect.

In order to open the fuel injection valve 1, an electrical circuit of the magnetic coil 18 is closed. The magnetic forces which then take effect pull in the armature 15. Together with this armature, the valve closing body 12 of the valve closing element 10 is moved away from valve seat 8, against the pressurizing compressing spring 17 thereby, the fuel can pass through the valve closing element 10 and its radial orifices 11 via the spiral flutes 16 to the valve seat 8 and downstream to at least one outlet orifice 9, and be ejected. The groove-like surrounding flute 22 between the guide cylinder 7 and the valve seat 8 facilitates a more even fuel distribution, thereby further improving the fuel processing.

Guide cylinders 7 and/or valve seat 8 and/or spiral flutes 16 in the guide cylinder 7 in valve seat body 5 can be particularly economically and accurately manufactured in their final form by stamping, with the stamping carried out by appropriately shaped dies.

It will be understood that each of the elements described above, or two or more together, may also find a useful application in other types of constructions differing from the types described above.

While the invention has been illustrated and described as embodied in an electromagnetically operated fuel injection valve, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electromagnetically operated fuel injection valve comprising a valve housing; a valve seat body having a valve seat and a guide cylinder provided with spiral flutes; a valve closing element projecting in and guided by said guide cylinder with said spiral flutes and supporting a ball type valve closing body around which fuel can flow through said spiral flutes in which said valve closing element interrupts or releases a fuel flow by sitting on or lifting off said valve seat, said valve seat body, in addition to said guide cylinder and said valve seat, also containing at least one outlet orifice, and said valve seat body being provided with a groove-like surrounding flute between said guide cylinder and said valve seat, said valve seat body being formed as a one-piece element which contains said guide cylinder, said valve seat, said outlet orifice and said groove-like surrounding flute.

2. An electromagnetically operated fuel injection valve as defined in claim 1, wherein said guide cylinder has a wall provided with said spiral flutes through which the fuel can flow.

3. An electromagnetically operated fuel injection valve as defined in claim 1, wherein said guide cylinder is a stamped member.

4. An electromagnetically operated fuel injection valve as defined in claim 1, wherein said valve seat is a stamped member.

5. An electromagnetically operated fuel injection valve as defined in claim 1, wherein said spiral flutes in said valve seat body are stamped formations.

6. An electromagnetically operated fuel injection valve as defined in claim 1, wherein said guide cylinder, said valve seat and said spiral flutes and said valve seat body are stamped members.

7. An electromagnetically operated fuel injection valve as defined in claim 1; and further comprising a welded connection that supports said valve seat body in said valve housing.

8. An electromagnetically operated fuel injection valve comprising a valve housing; a valve seat body having a valve seat and a guide cylinder provided with spiral flutes; a valve closing element projecting in and guided by said guide cylinder with said spiral flutes and supporting a ball type valve closing body around which fuel can flow through said spiral flutes in which said valve closing element interrupts or releases a fuel flow by sitting on or lifting off said valve seat, said valve seat body, in addition to said guide cylinder and said valve seat, also containing at least one outlet orifice, and said valve seat body being provided with a groove-like surrounding flute between said guide cylinder and said valve seat, said valve seat body being formed as a one-piece element which contains said guide cylinder, said valve seat, said outlet orifice and said groove-like surrounding flute, said valve seat body forming a free end of the fuel injection valve and being arranged directly near an inlet valve of an internal combustion engine.

* * * * *